US008468616B2

(12) United States Patent
Song et al.

(10) Patent No.: US 8,468,616 B2
(45) Date of Patent: Jun. 25, 2013

(54) VACUUM-AIDED TOILET

(75) Inventors: Bin Song, Shandong (CN); Jing Tang, Shandong (CN); Dan Liu, Shandong (CN); Chaomin Bai, Shandong (CN)

(73) Assignee: Shandong Huateng Environmental Protection Automation Co., Ltd, Shangdong (CN)

( * ) Notice: Subject to any disclaimer, the term of this patent is extended or adjusted under 35 U.S.C. 154(b) by 0 days.

(21) Appl. No.: 13/171,297

(22) Filed: Jun. 28, 2011

(65) Prior Publication Data

US 2011/0252554 A1 Oct. 20, 2011

Related U.S. Application Data

(63) Continuation of application No. PCT/CN2010/074679, filed on Jun. 29, 2010.

(30) Foreign Application Priority Data

Sep. 24, 2009 (CN) ..... 2009 2 0311288 U

(51) Int. Cl.
*E03D 11/00* (2006.01)

(52) U.S. Cl.
USPC ..... 4/431

(58) Field of Classification Search
USPC ..... 4/209 R, 211, 400–442
See application file for complete search history.

(56) References Cited

U.S. PATENT DOCUMENTS

| | | | | |
|---|---|---|---|---|
| 4,159,500 | A * | 6/1979 | Baumbach et al. | 361/119 |
| 5,369,811 | A * | 12/1994 | Serre | 4/213 |
| 5,396,668 | A * | 3/1995 | Haatanen | 4/431 |
| 5,495,626 | A * | 3/1996 | Lindroos et al. | 4/435 |
| 5,644,802 | A * | 7/1997 | Olin | 4/431 |
| 5,873,135 | A * | 2/1999 | Tornqvist | 4/431 |
| 6,243,887 | B1 * | 6/2001 | Palffy et al. | 4/431 |
| 7,594,282 | B2 * | 9/2009 | Shirai | 4/328 |
| 2004/0064881 | A1 * | 4/2004 | Breiing et al. | 4/431 |
| 2007/0226887 | A1 * | 10/2007 | Lappalainen et al. | 4/431 |
| 2009/0151063 | A1 * | 6/2009 | Shirai et al. | 4/415 |
| 2010/0088813 | A1 * | 4/2010 | Onishi et al. | 4/347 |

FOREIGN PATENT DOCUMENTS

| | | |
|---|---|---|
| CN | 2116726 | 9/1992 |
| CN | 1221059 | 6/1999 |
| CN | 1064429 | 4/2001 |
| CN | 2504329 | 8/2002 |

(Continued)

OTHER PUBLICATIONS

International Search Report of International Application No. PCT/CN2010/074679, dated Jun. 29, 2010.

*Primary Examiner* — Lori Baker
(74) *Attorney, Agent, or Firm* — J.C. Patents

(57) ABSTRACT

A vacuum-aided toilet comprises a toilet bowl, a deodorization pipeline, a flushing pipeline, a sensing switch (4) and a control device. A flushing port of the toilet bowl is communicated with the deodorization pipeline. The deodorization pipeline is communicated to a vacuum device. Inside the toilet bowl are provided a trap I (1.1), a trap II (1.2) and a draining port (1.3). The flushing pipeline being connected to the flushing port of the toilet bowl and the trap II (1.2), respectively. The sensing switch (4) is connected to a control device, which controls the deodorization pipeline and the flushing pipeline. An ejector (2.4) mounted on an air discharge pipeline (2.5) is directly driven by gas from an air outlet of a ventilating fan (2.2), so that vacuum is produced in a draining pipe. Thus the vacuum-aided toilet can save water and get rid of the odor.

3 Claims, 4 Drawing Sheets

FOREIGN PATENT DOCUMENTS

| | | |
|---|---|---|
| CN | 2575188 | 9/2003 |
| CN | 200996177 | 12/2007 |
| CN | 201209271 | 3/2009 |
| CN | 101691777 | 4/2010 |
| CN | 201512849 | 6/2010 |
| JP | 2007-46309 | 2/2007 |
| JP | 2008-156879 | 7/2008 |

* cited by examiner

VACUUM-AIDED TOILET

CROSS-REFERENCE TO RELATED APPLICATIONS

This application is a continuation of the international application No. PCT/CN2010/074679 filed on Jun. 29, 2010, which claims the priority benefits of Chinese application No. 200920311288.9 filed on Sep. 24, 2009. The contents of those prior applications are hereby incorporated by reference in their entirety.

FIELD OF THE TECHNOLOGY

The present invention relates to a toilet, in particular to a vacuum-aided toilet capable of saving water and deodorization.

BACKGROUND

Currently, toilets in the market mostly adopt gravity or gravity plus siphon flushing to drain. The major disadvantage of these two ways of flushing is large water consumption. Even a water-saving toilet, the water volume for each flushing is 7-8 liters. Statistics shows that the water for flushing a toilet amounts to about 40% of everyday water usage, which brings a more serious challenge to the water resources of our country.

Additionally, the public has always been perplexed by washroom odor which is mainly emitted from ammonia and sulphur-containing substance generated by the decomposition of human excretion. In case of a high concentration of such odor, one might be poisoned. Ventilation is mainly adopted in the traditional method, while the exhaust port for a washroom in some high buildings is generally relatively small and narrow, thus the effect of natural ventilation is poor. In case of windless and temperature-inverted weather, it is difficult for the odor in the washroom to be discharged outside, which will be even diffused indoor, thereby polluting the indoor atmosphere environment.

The prior Chinese patent applications No. 98126485.9, 01241556.1, and 200620138598.1 propose deodorizing methods and apparatuses for toilets, respectively, wherein there are only provided methods of how to achieve deodorization. In the Chinese utility model patent application No. 95193959.9, there is provided a vacuum apparatus containing an ejector and a vacuum toilet system containing the same apparatus. However, this apparatus requires an independent compressed air source as the working medium of the ejector to enable its suction case to generate vacuum, thus its usage environment and condition is strictly limited.

SUMMARY

In order to overcome the above drawbacks in the prior art, the present invention provides a vacuum-aided toilet, which eliminates odor from the source of the washroom odor by using a ventilating fan, and meanwhile uses the air at the ventilation port of the ventilating fan as the working medium of an air ejector, such that certain negative pressure is generated inside a draining pipeline, thereby draining under the common action of flushing water pressure, excretion gravity, and aided negative pressure, so as to achieve the objective of reducing the flushing water consumption of the toilet and relieving the washroom odor.

In order to achieve the above objective, the present invention employs the following technical solution:

1. A vacuum-aided toilet, comprising a toilet bowl, a deodorization pipeline, a flushing pipeline, and a sensing switch, wherein a flushing port of the toilet bowl is communicated with the deodorization pipeline, and the deodorization pipeline is connected to a vacuum device; inside the toilet bowl are provided a trap I, a trap II, and a draining port, the flushing pipeline being connected to the flushing port of the toilet bowl and the trap II, respectively; the sensing switch is connected to the control device, which controls the deodorization pipeline and flushing pipeline.

2. The toilet bowl comprises a trap I, a trap II, and a draining port. The trap I and trap II are used to form an enclosed space inside a draining pipeline of the toilet bowl to facilitate the formation of vacuum, wherein the flushing port includes a first flushing port, a second flushing port, and a third flushing port provided on the upper portion of the toilet bowl, adjacent to the trap II, and on the upper portion of the draining pipeline.

3. The deodorization pipeline comprises a ventilating pipeline and a vacuum pipeline, wherein the ventilating pipeline is connected to the first flushing port, on the ventilating pipeline are provided a check valve, a ventilating fan, and an ejector, the ejector being connected to an air discharge pipeline; the vacuum pipeline comprises a vacuum tank, the vacuum tank is connected to the second flushing port, a valve II being provided between the vacuum tank and the second flushing port, and at the other side, the vacuum tank is connected to the ejector, and a valve I is provided between the vacuum tank and the ejector.

4. The flushing pipeline comprises a water flushing pipeline and an air suction and flushing pipeline both connected to a water pipe, wherein the water flushing pipeline is connected with the trap II via a valve V, while the air suction and flushing pipeline is connected to the first flushing port via a valve III.

The toilet of the present invention comprises a toilet bowl 1, a ventilating unit, a water flushing pipeline 3.3, a sensing switch 4, and a control device 5, etc. The toilet bowl 1 comprises a trap I 1.1, a trap II 1.2, and a draining port 1.3. The ventilating unit comprises a check valve II 2.1, a ventilating fan 2.2, a ventilating pipeline 2.3, an ejector 2.4, an air discharge pipeline 2.5, a valve I 2.6, a vacuum tank 2.7, a vacuum pipeline 2.8, a valve II 2.9, and an air suction and flushing pipeline 2.10; and the water flushing pipeline 3.3 comprises a valve III 3.1, a valve IV 3.2, and a flushing pipeline.

The working process is specified below:

1. When the sensing switch 4 senses someone is using the toilet, the ventilating fan 2.2 starts working, and driving the ejector 2.4 to work. After they start working, on one hand, the ventilating fan 2.2 sucks the odor that emitted from the human excretion through a first flushing port 1.4 which is provided on the upper portion of the toilet bowl 1 inside the toilet bowl 1, the odor being discharged to an exhaust duct of the building via the outlet of the ejector 4 and the air discharge pipeline 2.5; on the other hand, while the two are working, valve I 2.6 is turned on, certain vacuum is created in the vacuum tank 2.7 and vacuum pipeline 2.8 by the working of the ejector 2.4. The specific working state is illustrated in FIG. 2.

2. When the sensing switch 4 senses that someone leaves, valve I 2.6 is turned off, valve II 2.9 and valve III 3.1 are turned on, turning on valve II 2.9 causes the vacuum in the vacuum tank 2.7 being applied to the draining pipeline 1.6 via a second flushing port 1.5 which is provided on the upper portion of the draining pipeline 1.6; while the flushing is performed normally by the toilet bowl 1, under the dual actions of the vacuum and gravity, the draining is preformed inside the draining pipeline 1.6 through the draining port 1.3. The specific working state is illustrated in FIG. 3.

3. After the flushing and drainage are performed by the toilet bowl 1, except for valve IV 3.2 and valve 3.5, all the other valves are turned off. At this moment, the trap II 1.2 is flushed via the flushing pipeline and a third flushing port 1.7 which is provided adjacent to the trap II 1.2. On one hand, it may prevent the accumulation of excretion in trap II 1.2 that will affect the next draining effect of the toilet bowl 1. On the other hand, it effectively guarantees the water-seal quality in trap II 1.2, thereby guaranteeing an enclosed space is formed inside the draining pipeline 1.6, so as to prepare for the next flushing cycle. The specific working state is illustrated in FIG. 4.

The present invention has the following advantages: using a ventilating fan to directly drive the ejector to work, it is not only simple in principle and structure, convenient for use, but also overcomes the deficiency of large water consumption in a conventional toilet that only adopts ways of gravity or gravity plus siphon for draining, and meanwhile overcomes the disadvantages such as the big washroom odor when someone is using the toilet. The present invention achieves the objective of reducing water consumption for flushing, improving the environment of the washroom, this toilet has no special requirements for the gravity pipeline that used for draining, it will meet all the usage requirements either in a newly built or reconstructed situation.

Figure 1:
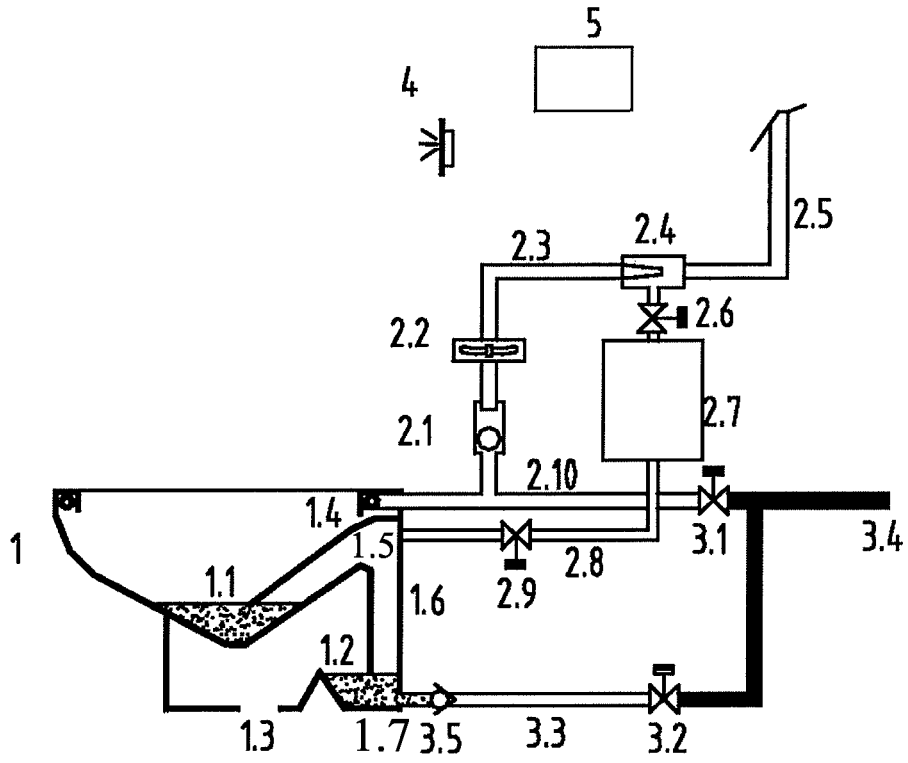
FIG. 1 is a structural diagram of the toilet according to an embodiment of the present invention.

In the drawings, numerical references have the following meanings: 1 toilet bowl; 1.1 trap I; 1.2 trap II; 1.3 draining port; 1.4 first flushing port; 1.5 second flushing port; 1.7 third flushing port; 1.6 draining pipeline; 2.1 check valve; 2.2 ventilating fan; 2.3 ventilating pipeline; 2.4 ejector; 2.5 air discharge pipeline; 2.6 valve I; 2.7 vacuum tank; 2.8 vacuum pipeline; 2.9 valve II; 2.10 air suction and flushing pipeline; 3.1 valve III; 3.2 valve IV; 3.3 water flushing pipeline; 3.4 water pipe; 3.5 valve V; 4 sensing switch; 5 control device.

DETAILED DESCRIPTION

Hereinafter, the present invention will be further described through the embodiments with reference to the drawings.

Figure 2:
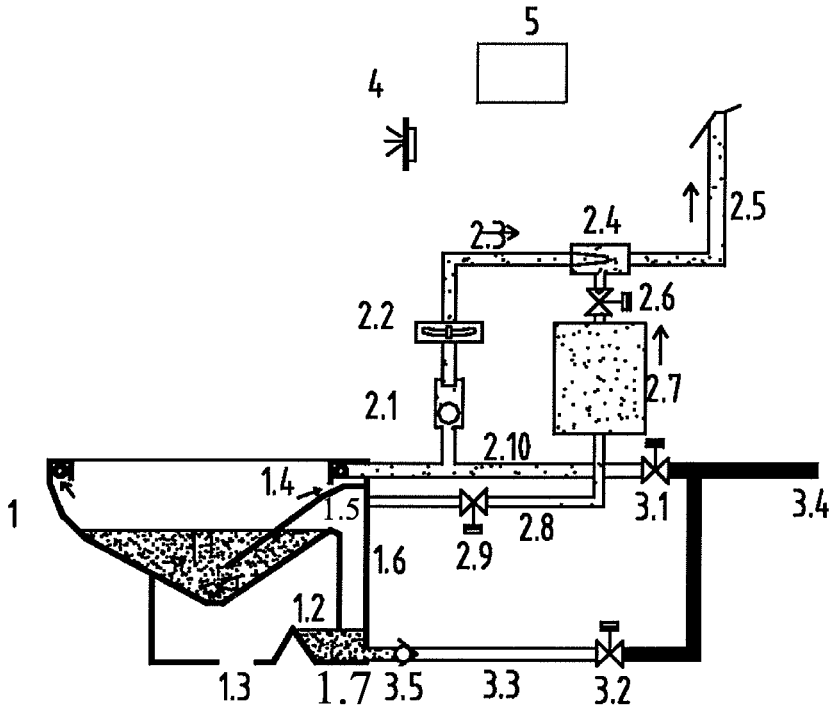
FIG. 2 is a diagram showing the working state of an air discharge pipeline according to an embodiment of the present invention.
Figure 3:
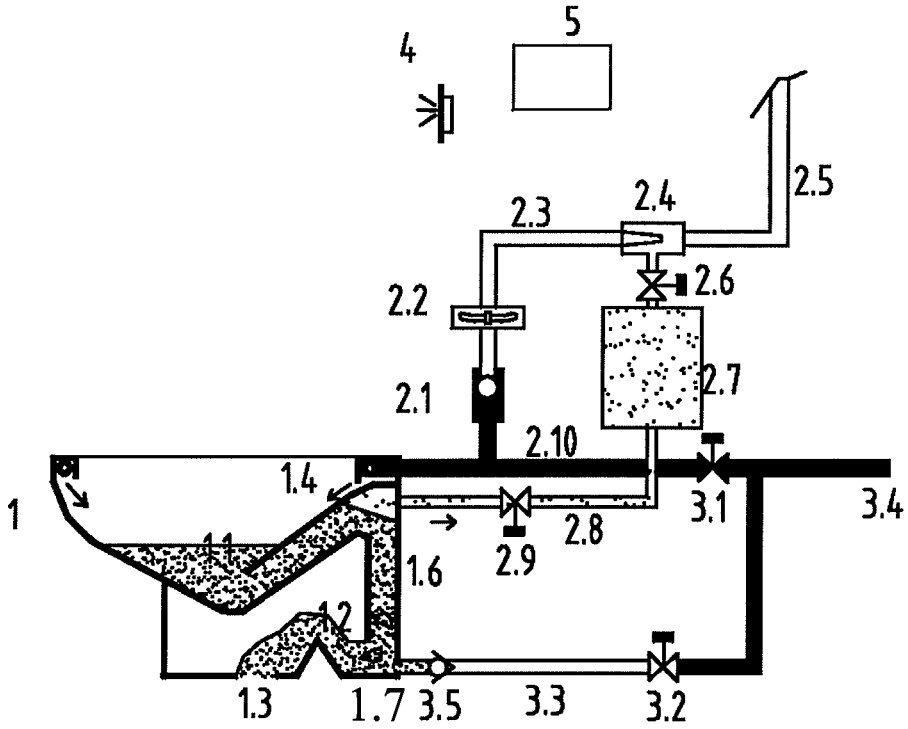
FIG. 3 is a diagram showing the working state of air suction plus flushing pipeline according to an embodiment of the present invention.
Figure 4:
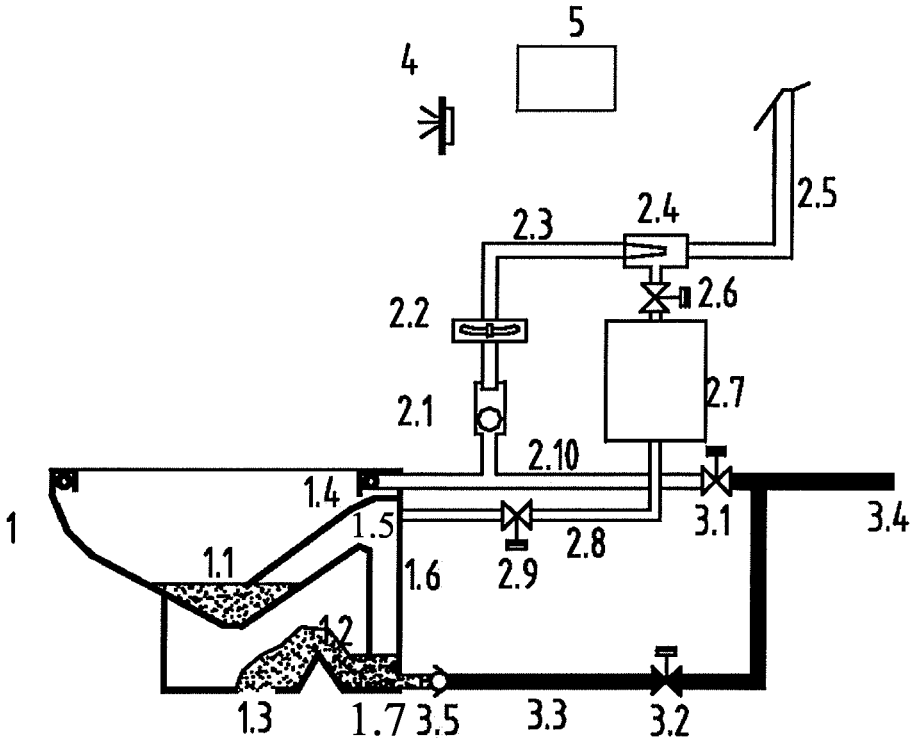
FIG. 4 is a diagram showing the working state of a water flushing pipeline according to an embodiment of the present invention.

In FIG. 1, FIG. 2, FIG. 3, and FIG. 4, it comprises a toilet bowl 1, a deodorization pipeline, a flushing pipeline, and a sensing switch 4, wherein the first, second, and third flushing ports 1.4, 1.5 and 1.7 of the toilet bowl communicate with the deodorization pipeline and the flushing pipeline, respectively, and the deodorization pipeline is connected to a vacuum device; inside the toilet bowl 1 are provided a trap I 1.1, a trap II 1.2, and a draining port 1.3, the flushing pipeline being connected to the first and third flushing ports 1.4 and 1.7 of the toilet bowl 1 and the trap II 1.2, respectively; the sensing switch 4 is connected to a control device 5 that controls the deodorization pipeline and flushing pipeline.

The deodorization pipeline comprises a ventilating pipeline 2.3 and a vacuum pipeline 2.8, wherein the ventilating pipeline 2.3 is connected to the first flushing port 1.4, on the ventilating pipeline 2.3 being provided in sequence a check valve 2.1, a ventilating fan 2.2, and an ejector 2.4, the ejector 2.4 being connected to an air discharge pipeline 2.5; the vacuum pipeline 2.8 comprises a vacuum tank 2.7, the vacuum tank 2.7 is connected to the second flushing port 1.5, a valve II 2.9 is provided between the vacuum tank 2.7 and the second flushing port 1.5, the vacuum tank 2.7 is connected to the ejector 2.4 at the other side, and a valve I 2.6 is provided between the vacuum tank 2.7 and the ejector 2.4.

The flushing pipeline is divided into a water flushing pipeline 3.3 and an air suction and flushing pipeline 2.10 both connected to the water pipe 3.4, wherein the water flushing pipeline 3.3 is connected to the third flushing port 1.7 of the trap II 1.2 via a valve V 3.5, while the air suction and flushing pipeline 2.10 is connected to the first flushing port 1.4 via a valve III 3.1.

With the vacuum-aided flushing, the present invention achieves the objective of reducing water consumption for flushing and relieving the washroom odor. It uses the air at the ventilation port of the ventilating fan 2.2 as the working medium of an ejector 2.4 to generate vacuum in a drainage pipeline 1.6 and uses the ventilating fan 2.2 to discharge the odor emitted from the excretion that is generated by one relieving himself/herself through the first flushing port 1.4 inside the toilet bowl 1. Inside the toilet bowl 1 are provided two traps, trap I 1.1 and trap II 1.2, that form a closed space inside the draining pipeline 1.6, so as to facilitate the formation of vacuum. The trap I 1.1 and the trap II 1.2 communicate with each other via the draining pipeline 1.6, and an enclosed space is formed within the draining pipeline 1.6 between the trap I 1.1 and the trap II 1.2, an upper portion of the draining pipeline 1.6 is positioned above both the trap I 1.1 and the trap II 1.2 along a vertical direction, the vacuum pipeline 2.8 is connected to the second flushing port 1.5 on the upper portion of the draining pipeline 1.6. The deodorization pipeline mainly comprises a ventilating fan 2.2, an ejector 2.4, a vacuum tank 2.7, an electromagnetic valve 2.6, and a one-way valve 2.1, for functioning to enable the draining pipeline 1.6 to generate a vacuum and to discharge the washroom odor. The water flushing pipeline 3.3 comprises two portions, with one portion providing the water required by the toilet bowl 1 for normal flushing, and the other portion providing flushing to the other trap so as to prevent accumulation of excretion thereat.

Although the present invention has been illustrated above with reference to the preferred embodiments, it should be understood that some changes are allowed within the scope of the claims. For example, the sensing switch 4 can be changed into other sensing manner to generate a trigger signal and achieve the same effect.

What is claimed is:

1. A vacuum-aided toilet, comprising a toilet bowl, a deodorization pipeline, a flushing pipeline, a draining pipeline, a sensing switch and a control device, wherein:

the deodorization pipeline comprises a ventilating pipeline and a vacuum pipeline, the flushing pipeline comprises a water flushing pipeline and an air suction and flushing pipeline;

a first flushing port is provided at an upper portion of the toilet bowl and connected with the air suction and flushing pipeline, and the first flushing port is also connected to the ventilating pipeline;

the control device communicates with the sensing switch, the deodorization pipeline and the flushing pipeline, respectively;

the toilet bowl comprises a trap I, a trap II, and a draining port which is located downstream of the trap II for draining excretion in the toilet bowl, the trap I and the trap II are connected with each other via the draining pipeline, and an enclosed space is formed within the draining pipeline between the trap I and the trap II, an upper portion of the draining pipeline is positioned above both the trap I and the trap II along a vertical direction, a second flushing port is provided at the upper portion of the draining pipeline, one end of the vacuum pipeline is connected to the second flushing port, the other end of the vacuum pipeline is connected to a first side of a vacuum tank, a value II is provided on the vacuum pipeline between the vacuum tank and the second flushing port, and the trap II communicates with the water flushing pipeline via a third flushing port adjacent to the trap II.

2. The vacuum-aided toilet according to claim 1, wherein: on the ventilating pipeline are provided a check valve, a ventilating fan, and an ejector, the ejector being connected to an air discharge pipeline; a second side of the vacuum tank is connected to the ejector and a valve I is provided between the vacuum tank and the ejector.

3. The vacuum-aided toilet according to claim 1, wherein: the water flushing pipeline and the air suction and flushing pipeline both are connected to a water pipe, wherein a valve V is provided on the water flushing pipeline between the third flushing port and the water pipe, and a valve III is provided on the air suction and flushing pipeline between the first flushing port and the water pipe.

* * * * *